US008993021B2

(12) United States Patent
Nishibe et al.

(10) Patent No.: US 8,993,021 B2
(45) Date of Patent: Mar. 31, 2015

(54) CAN BOTTLES IN A BOTTOMED, CYLINDRICAL CONFIGURATION, AND CAN PRODUCTS FILLED UP THEREIN WITH A SOFT OR HARD DRINK

(75) Inventors: Tadashi Nishibe, Tokyo (JP); Chiharu Ito, Tokyo (JP)

(73) Assignee: Kirin Beer Kabushiki Kaisha, Tokyo (JP)

( * ) Notice: Subject to any disclaimer, the term of this patent is extended or adjusted under 35 U.S.C. 154(b) by 230 days.

(21) Appl. No.: 13/393,061

(22) PCT Filed: Sep. 2, 2010

(86) PCT No.: PCT/JP2010/065459

§ 371 (c)(1),
(2), (4) Date: Feb. 28, 2012

(87) PCT Pub. No.: WO2011/027910

PCT Pub. Date: Mar. 10, 2011

(65) Prior Publication Data

US 2012/0156335 A1 Jun. 21, 2012

(30) Foreign Application Priority Data

Sep. 2, 2009 (JP) ..... 2009-202231
Sep. 24, 2009 (JP) ..... 2009-218575

(51) Int. Cl.
*B65D 1/16* (2006.01)
*B65D 1/02* (2006.01)
*B65D 1/40* (2006.01)

(52) U.S. Cl.
CPC ..... *B65D 1/165* (2013.01); *B65D 1/0284* (2013.01); *B65D 1/40* (2013.01)
USPC ..... 426/131; 426/397; 220/606; 220/609; 220/635; 215/375; 215/377

(58) Field of Classification Search
CPC ..... B65D 1/165; B65D 1/0284
USPC ..... 426/131, 118, 106, 115, 395, 397, 399, 426/590–599; 220/906, 604–606, 608–609, 220/635; 215/371–377
See application file for complete search history.

(56) References Cited

U.S. PATENT DOCUMENTS 3,935,955 A * 2/1976 Das ..... 215/375
4,175,670 A * 11/1979 Reynolds et al. ..... 220/606
(Continued)

FOREIGN PATENT DOCUMENTS

JP A-2002-515842 5/2002

OTHER PUBLICATIONS

Oct. 19, 2010 International Search Report issued in International Patent Application No. PCT/JP2010/065459 (with translation).

*Primary Examiner* — Drew Becker
(74) *Attorney, Agent, or Firm* — Oliff PLC

(57) ABSTRACT

A can bottle in a bottomed, cylindrical configuration, which is constructed of a metal material has a cylindrical side wall and a bottom joined to and integrated with the side wall. The said bottom includes domed portions that flex and extend downwardly and outwardly, and flexed support legs formed by extending a plurality of peripheral edge sites of the domed portions arranged at uniform angles further downwardly and outwardly in a flexed fashion. The bottom satisfies a condition: $1.04 \leq R3/D \leq 1.67$ where R3 (mm) is the radius of curvature that defines the curvature of the domed portion at the bottom, and D (mm) is the diameter of the cylindrical side wall. In addition ribs are formed at possible grounding sites of the flexed support legs at said bottom in a direction crossing the radial direction.

15 Claims, 12 Drawing Sheets

(56) References Cited

U.S. PATENT DOCUMENTS

| | | | | | |
|---|---|---|---|---|---|
| D269,066 | S | * | 5/1983 | Gaunt | D9/779 |
| D272,418 | S | * | 1/1984 | Gruodis et al. | D9/779 |
| 4,732,292 | A | * | 3/1988 | Supik | 220/606 |
| 4,892,205 | A | * | 1/1990 | Powers et al. | 215/375 |
| 5,139,162 | A | * | 8/1992 | Young et al. | 215/375 |
| 5,353,954 | A | * | 10/1994 | Steward et al. | 220/608 |
| 5,427,258 | A | * | 6/1995 | Krishnakumar et al. | 215/400 |
| 5,529,196 | A | * | 6/1996 | Lane | 215/375 |
| 5,626,228 | A | * | 5/1997 | Wiemann et al. | 206/511 |
| 6,112,924 | A | * | 9/2000 | Zhang | 215/375 |
| 6,276,546 | B1 | * | 8/2001 | Davis et al. | 215/375 |
| 6,293,422 | B1 | * | 9/2001 | Jentzsch et al. | 220/608 |
| 7,051,889 | B2 | * | 5/2006 | Boukobza | 215/375 |

* cited by examiner

CAN BOTTLES IN A BOTTOMED, CYLINDRICAL CONFIGURATION, AND CAN PRODUCTS FILLED UP THEREIN WITH A SOFT OR HARD DRINK

FIELD OF THE INVENTION

The present invention relates generally to a can bottle in a bottomed, cylindrical configuration, and a can product that is filled up therein with a soft or hard drink, and sealed up with a lid, and specifically to a can bottle with its bottom having such morphological features that the rigidity of the bottom can be maintained even when it is made thinner than ever before and the freestanding capability of the can bottle is ensured even as the internal pressure rises, and a soft or hard drink can product. More specifically, the invention relates to a can bottle provided with a bottom having just only these morphological features but also a feature that is capable of preventing inward slippage of legs and enhancing buckling strength to vertical loads, and a soft or hard drink can product.

BACKGROUND ART

Generally for the bottom configuration of a so-called positive pressure can in which a carbonated drink like beer is sealingly contained, there has so far been a structure used, in which a central area accounting for most of the bottom is domed in such a way as to make its way into the can bottle, and ring-form bumps are joined to the outer periphery of the dome to provide a surface on which the bottom is to sit.

In such a general, conventional positive pressure can, the central portion of the bottom is domed in such a way as to make its way into the can bottle as described above, and the thickness of the bottom is set by far larger than that of the can shank forming the side wall of the can bottle.

Such positive pressure cans are now used on a huge market scale; so if the metal used for individual cans are able to be saved just a bit, it would end up with some considerable overall cost cuttings.

From such a point of view, Japanese Translation of PCT International Application Publication No. JP-T 2002-515842 shows that for the main purpose of reducing the thickness of the metal material of a can bottom wall, there is a bottom wall provided, in which an outwardly convex dome is provided, and a plurality of support legs, each of a substantially truncated quadrangular shape, are formed on that dome, and alternately located at spaces in a circumferential direction, extending down from the dome.

However, that publication discloses nothing about teachings enough to make sure resisting pressure and the freestanding capability of the can bottle: only with what is disclosed in that publication, there is a risk that even when the central area of the bottom bulges only a bit as the internal pressure rises, the freestanding capability of the can bottle may possibly be lost.

The situations being like this, the first idea (aspect) of the invention has for its object to provide a can bottle having a bottom that enables its rigidity to be maintained even when the bottom is made thin, and make sure the freestanding capability of the can bottle as the internal pressure rises, and a soft or hard drink can product using that can bottle.

The second idea (aspect) of the invention is an improvement in the first aspect of the invention, having for its objet to provide a can bottle having a bottom configuration capable of increasing buckling strength to vertical loads, and a soft or hard drink can product using that can bottle. To put it another way, a problem with a metal can having a so-called petaloid bottom configuration is that when there is a vertical load applied in the axial direction of the can bottle, the legs slip down toward the central portion of the bottom, deforming and starting to buckle up. The main purpose of the second aspect of the invention is to provide a solution to that problem.

SUMMARY OF THE INVENTION

First Aspect of the Invention

To accomplish the aforesaid object (1), the inventors have made study after study of a variety of parameters including leg height, the radius of curvature of the domed portion, and can diameter in particular, and found that processing limits to metal materials in general and aluminum in particular impose some restrictions on increasing leg height L, and in order to make sure the freestanding capability of the can bottle, the relation of the radius of curvature of the domed portion to the magnitude of can diameter is of vital importance. Such findings have underlain the invention of this application.

That is, the first aspect of the invention provides a can bottle in a bottomed, cylindrical configuration, which is constructed of a metal material and comprises a cylindrical side wall and a bottom joined to and integrated with said side wall, wherein said bottom includes domed portions that flex and extend downwardly and outwardly, and flexed support legs formed by extending a plurality of peripheral edge sites of the domed portions arranged at uniform angles further downwardly and outwardly in a flexed fashion, and wherein said bottom satisfies a condition: $1.04 \leq R_3/D \leq 1.67$ where $R_3$ (mm) is the radius of curvature that defines the curvature of the domed portion at the bottom, and D (mm) is the diameter of the cylindrical side wall.

In a preferable embodiment of the inventive can bottle in a bottomed, cylindrical configuration, that condition is narrowed down to $1.17 \leq R_3/D \leq 1.33$ where $R_3$ (mm) is the radius of curvature that defines the curvature of the domed portion at the bottom, and D (mm) is the diameter of the cylindrical side wall.

In a preferable embodiment of the inventive can bottle in a bottomed, cylindrical configuration, the diameter D (mm) of the cylindrical side wall is set at 52 to 95 mm.

In a preferable embodiment of the inventive can bottle in a bottomed, cylindrical configuration, the height L (mm) of each flexed support leg is set in such a way as to satisfy $0.12 \leq L/D \leq 0.18$ where D (mm) is the diameter of the side wall.

In a preferable embodiment of the inventive can bottle in a bottomed, cylindrical configuration, the bottom has an average thickness t (mm) enough to satisfy $0.0030 \leq t/D \leq 0.0045$ where D (mm) is the diameter of the side wall.

In a preferable embodiment of the inventive can bottle in a bottomed, cylindrical configuration, there are four to eight support legs provided.

In a preferable embodiment of the inventive can bottle in a bottomed, cylindrical configuration, the domed portions are defined by a gap between adjacent flexed support legs, and a central portion of the bottom surrounded by a plurality of flexed support legs.

In a preferable embodiment of the inventive can bottle in a bottomed, cylindrical configuration, the plurality of flexed support legs are located and constructed in a petaloid configuration.

A soft or hard drink can product of the invention is formed by filling a drink up in the can bottle in a bottomed, cylindrical configuration, and then sealing an opening with a lid.

In a preferable embodiment of the inventive soft or hard drink can product, the internal pressure of the can is set at up to 640 kPa.

In a preferable embodiment of the inventive soft or hard drink can product, the drink is a carbonated drink.

The first aspect of the invention provides a can bottle in a bottomed, cylindrical configuration, which is constructed of a metal material and comprises a cylindrical side wall and a bottom joined to and integrated with said side wall, wherein said bottom includes domed portions that flex and extend downwardly and outwardly, and flexed support legs formed by extending a plurality of peripheral edge sites of the domed portions arranged at uniform angles further downwardly and outwardly in a flexed fashion, and wherein said bottom satisfies a condition: $1.04 \leq R_3/D \leq 1.67$ where $R_3$ (mm) is the radius of curvature that defines the curvature of the domed portion at the bottom, and D (mm) is the diameter of the cylindrical side wall. The arrangement being like this, even when the bottom of the can bottle is thinned, it is possible just only to maintain the rigidity of the bottom of the can bottle but also to make sure the freestanding capability of the can bottle as the internal pressure grows high, for instance, even when the internal pressure of a soft or hard drink can bottle that has been filled up with a carbonated drink and sealed with a lid reaches as high as 640 kPa.

Second Aspect of the Invention

To accomplish the aforesaid object (2), the second aspect of the invention provides a can bottle in a bottomed, cylindrical configuration, which is constructed of a metal material and comprises a cylindrical side wall and a bottom joined to and integrated with said side wall, wherein said bottom includes domed portions that flex and extend downwardly and outwardly, and flexed support legs formed by extending (or bulging out) a plurality of peripheral edge sites of the domed portions arranged at uniform angles further downwardly and outwardly in a flexed fashion, and wherein there are ribs formed at possible grounding sites of the flexed support legs at said bottom in a direction crossing the radial direction.

In a preferable embodiment of the inventive can bottle in a bottomed, cylindrical configuration, the grounding sites of the flexed support legs at the bottom define the most extended positions of the flexed support legs, and the ribs are formed in a direction crossing a radial line of flexion passing through said positions.

In a preferable embodiment of the inventive can bottle in a bottomed, cylindrical configuration, said ribs are formed such that there are two or more grounding points provided at the can bottle's bottom per one flexed support leg.

In a preferable embodiment of the inventive can bottle in a bottomed, cylindrical configuration, said ribs are formed such that said ribs per se each define two or more grounding points at the can bottle's bottom.

In a preferable embodiment of the inventive can bottle in a bottomed, cylindrical configuration, said ribs are each configured into a concavely dented shape as viewed in cross section in the radial section passing through the most extended position of the flexed support leg.

In a preferable embodiment of the inventive can bottle in a bottomed, cylindrical configuration, each or the rib is configured in an elongated, dented groove shape.

In a preferable embodiment of the inventive can bottle in a bottomed, cylindrical configuration, there are four to eight flexed support legs provided, each one including said rib.

In a preferable embodiment of the inventive can bottle in a bottomed, cylindrical configuration, another rib is added to and formed at the most extended position of the flexed support leg at said bottom such that two ribs cross each other at the most extended position.

In a preferable embodiment of the inventive can bottle in a bottomed, cylindrical configuration, said two ribs are provided in such a way as to cross each other, whereby there are four grounding points provided at the can bottle's bottom per one flexed support leg.

In a preferable embodiment of the inventive can bottle in a bottomed, cylindrical configuration, said bottom satisfies a condition: $1.04 \leq R_3/D \leq 1.67$ where $R_3$ (mm) is the radius of curvature that defines the curvature of the domed portion, and D (mm) is the diameter of the cylindrical side wall.

In a preferable embodiment of the inventive can bottle in a bottomed, cylindrical configuration, the diameter D (mm) of the cylindrical side wall is set at 52 to 95 mm.

In a preferable embodiment of the inventive can bottle in a bottomed, cylindrical configuration, the height L (mm) of each or the flexed support leg is provided in such a way as to satisfy $0.12 \leq L/D \leq 0.18$ where D (mm) is the diameter of the side wall.

In a preferable embodiment of the inventive can bottle in a bottomed, cylindrical configuration, the bottom has an average thickness t (mm) enough to satisfy $0.0030 \leq t/D \leq 0.0045$ where D (mm) is the diameter of the side wall.

In a preferable embodiment of the inventive can bottle in a bottomed, cylindrical configuration, the domed portions are defined by a gap between adjacent flexed support legs, and a central portion of the bottom surrounded by a plurality of flexed support legs.

In a preferable embodiment of the inventive can bottle in a bottomed, cylindrical configuration, the plurality of flexed support legs are located and constructed in a petaloid configuration.

A soft or hard drink can product of the invention is formed by filling a drink up in the can bottle in a bottomed, cylindrical configuration, and then sealing an opening with a lid.

In a preferable embodiment of the inventive soft or hard drink can product, the internal pressure of the can is set at up to 640 kPa.

In a preferable embodiment of the inventive soft or hard drink can product, the drink is a carbonated drink.

The second aspect of the invention provides a can bottle in a bottomed, cylindrical configuration, which is constructed of a metal material having a cylindrical side wall and a bottom joined to and integrated with said side wall, wherein said bottom includes domed portions that flex and extend downwardly and outwardly, and flexed support legs formed by extending (or bulging out) a plurality of peripheral edge sites of the domed portions arranged at uniform angles further downwardly and outwardly in a flexed fashion, and wherein there are ribs formed at possible grounding sites of the flexed support legs at said bottom in a direction crossing the radial direction. The arrangement being like this, even when the bottom of the can bottle is thinned, it is possible to maintain the rigidity of that bottom. In particular, it is possible to prevent inward slippage of the legs, resulting in the ability to make buckling strength to vertical loads much higher.

Advantages

According to the second aspect of the invention wherein the inventive ribs are provided at given sites of the bottom, when there is a vertical load applied in the axial direction, it is possible to prevent inward slippage of the legs, and keep the central portion of the bottom against rising. These preventive actions contribute much more to improvements in buckling strength to vertical loads.

BEST MODE FOR CARRYING OUT THE INVENTION

Explanation of the First Aspect of the Invention

The can bottle in a bottomed, cylindrical configuration according to the first aspect of the invention, and a drink can product obtained by filling a drink in that can bottle and sealing it with a lid will now be explained in further details.

First of all, the can bottle in a bottomed, cylindrical configuration is explained.

Explanation of the Can Bottle in a Bottomed, Cylindrical Configuration

Figure 1:
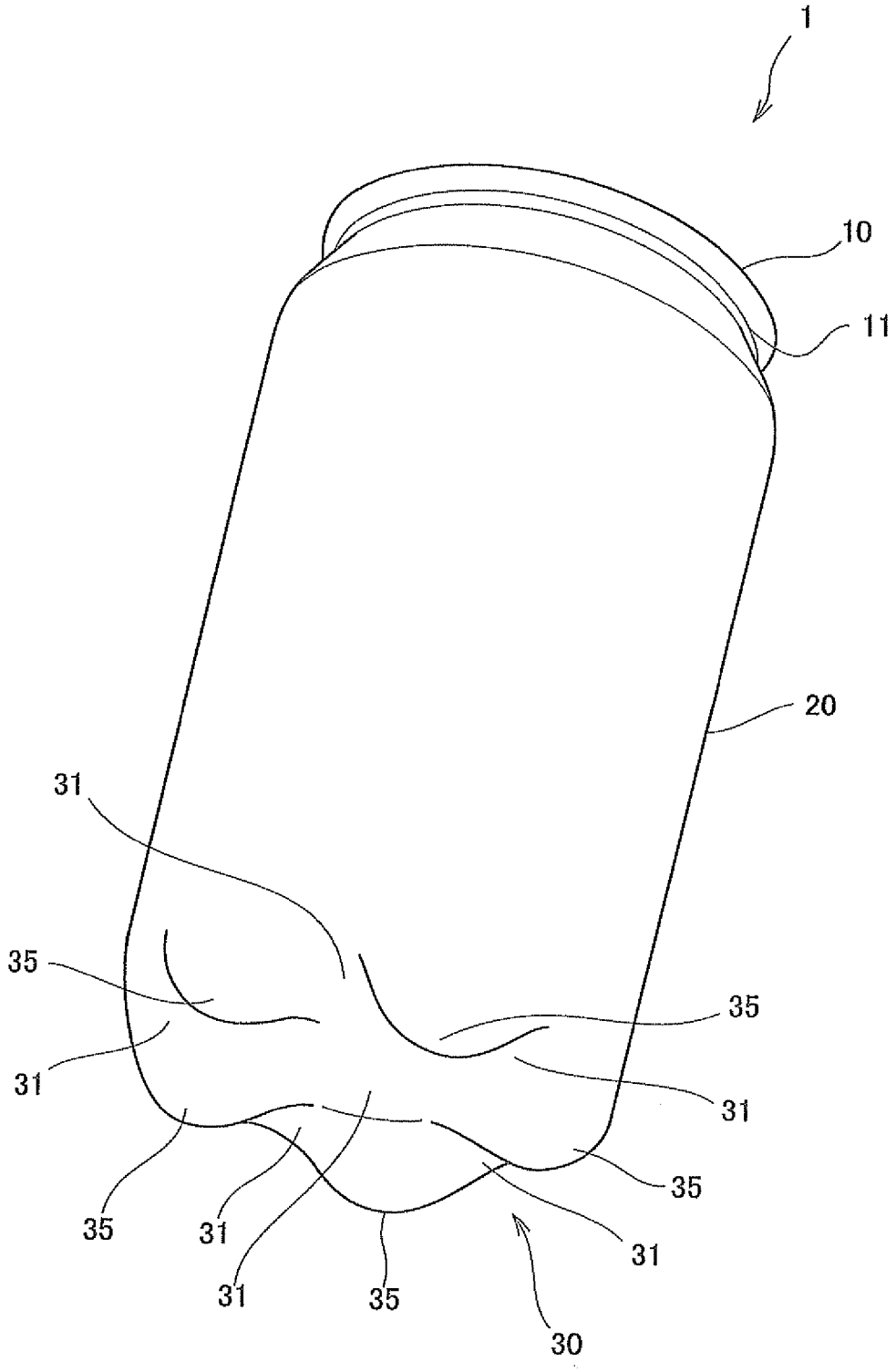
FIG. 1 is a schematic perspective view of the inventive can bottle in a cylindrical bottomed configuration, as viewed from the bottom direction.
Figure 2:
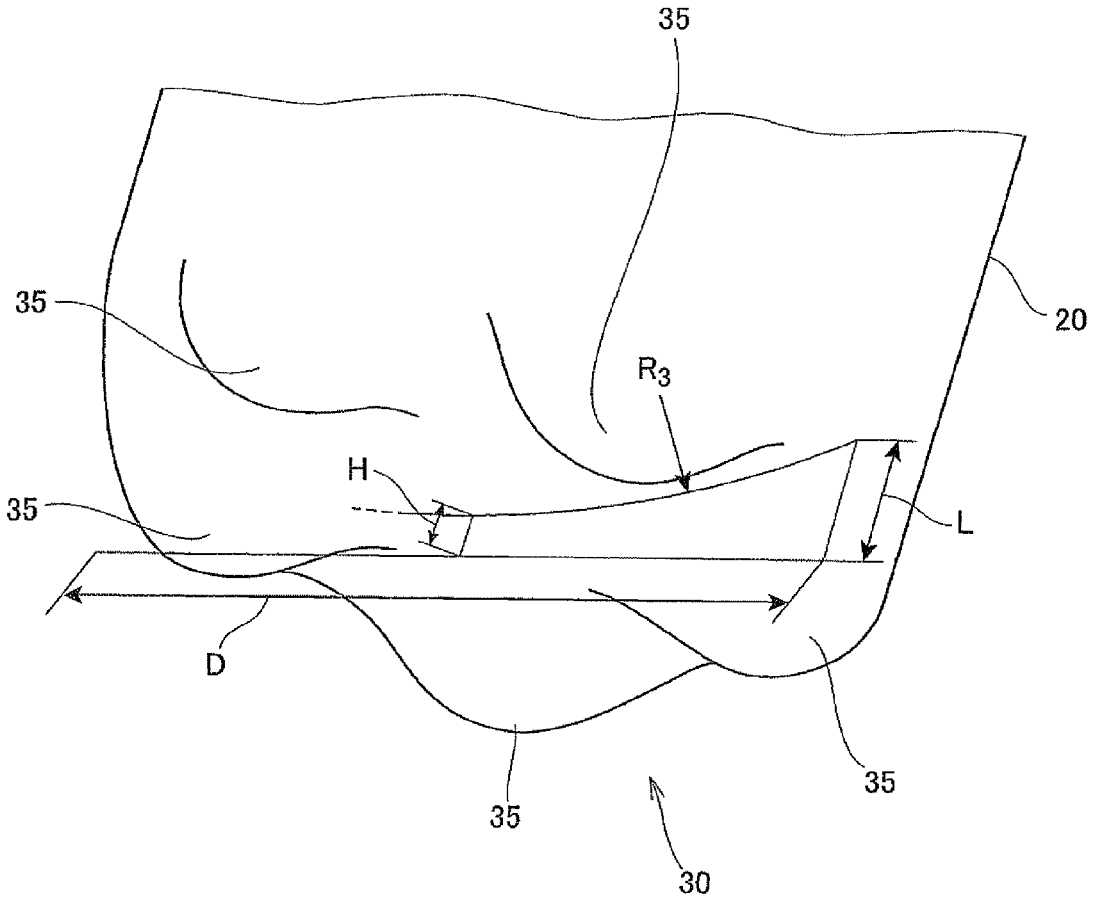
FIG. 2 is a schematically enlarged perspective view of the bottom of the inventive can bottle in a bottomed, cylindrical configuration.
Figure 3:
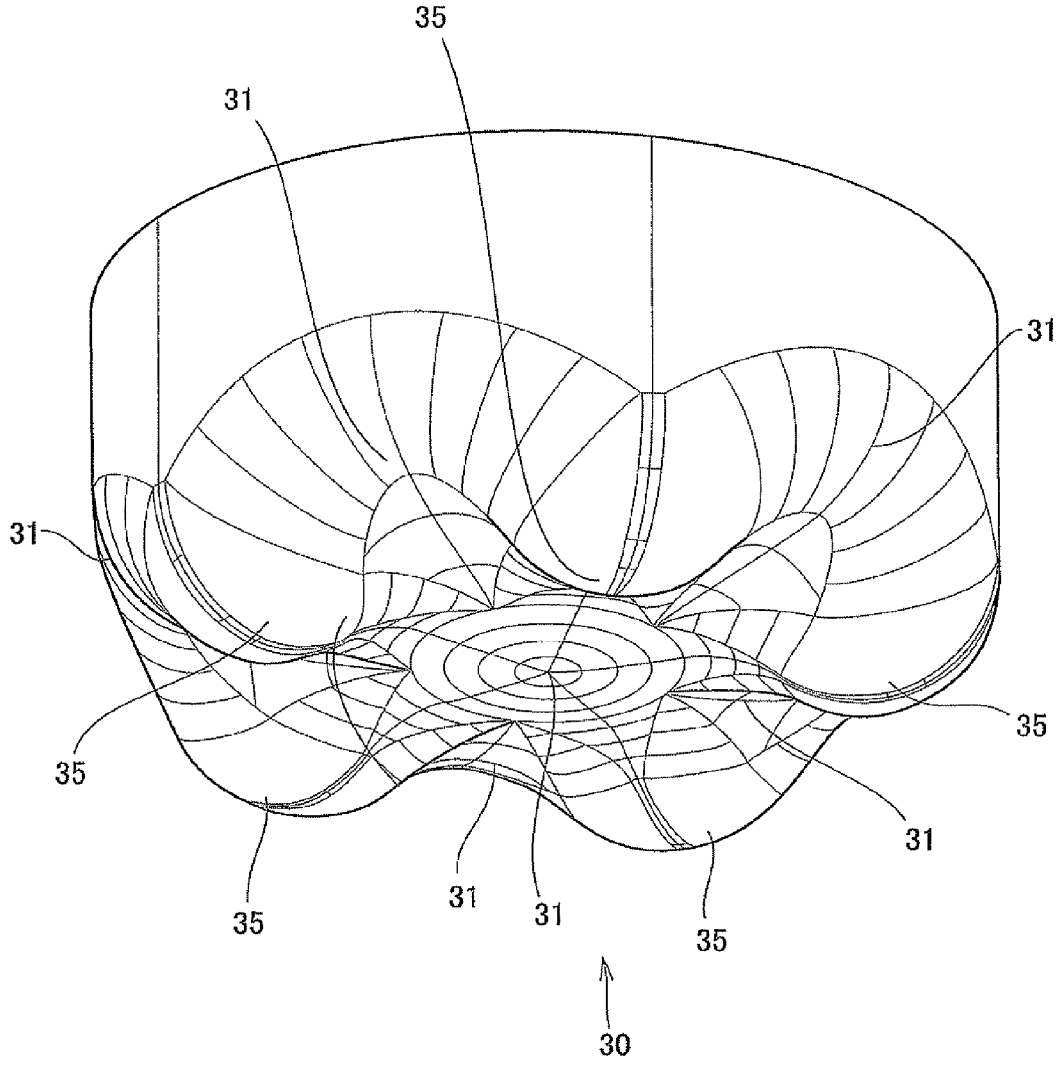
FIG. 3 is a schematically enlarged perspective view, as in FIG. 2, of the bottom, wherein the morphological image of a bump-and-dip arrangement is indicated by lines.
Figure 4:
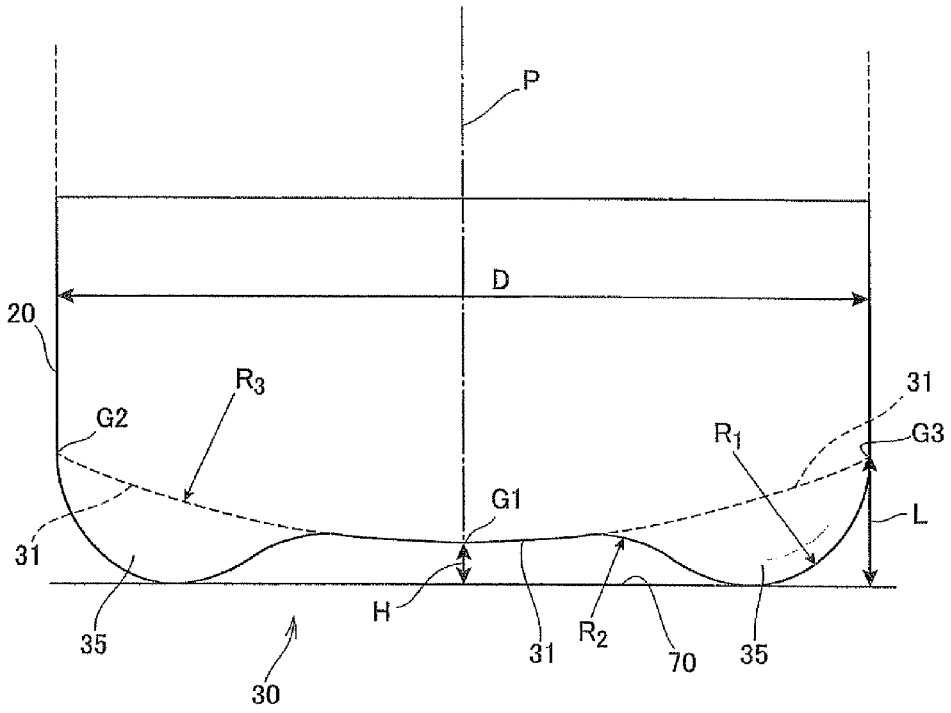
FIG. 4 is a schematically sectional view of the bottom of the can bottle, wherein four (or six or eight) flexed support legs are provided such that the sections of the flexed support legs appear uniformly at both ends of the drawing sheet, and the flexed support legs are arranged uniformly in the radial direction. Note here that the interior of the can bottle is not yet pressurized.
Figure 5:
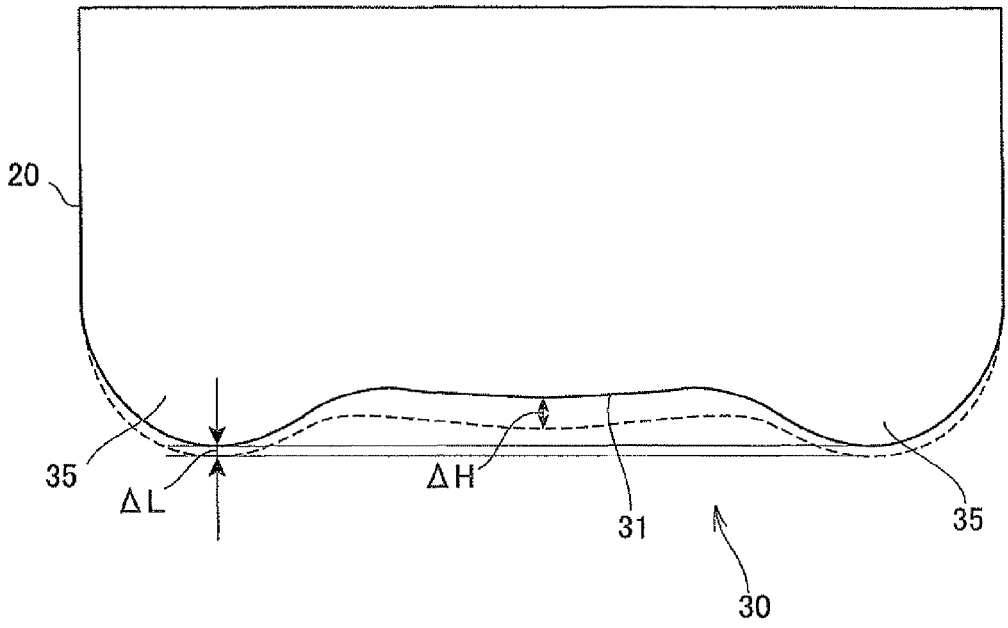
FIG. 5 is a schematically sectional view of how the bottom of the can bottle serving as a drink can product deforms by being pressurized, wherein four (or six or eight) flexed support legs are provided such that the sections of the flexed support legs appear uniformly at both ends of the drawing sheet, and the flexed support legs are arranged uniformly in the radial direction. A solid line and a dotted line at the bottom are indicative of before and after pressurization, respectively. That is, the dotted line is indicative of the drink can product that is being pressurized or a positive pressure can.

FIG. 1 is a schematically perspective view of the inventive can bottle in a bottomed, cylindrical configuration, as viewed from the bottom direction; FIG. 2 is a schematically enlarged perspective view of the bottom of the can bottle; FIG. 3 is a schematically enlarged perspective view, similar to FIG. 1, of the bottom wherein the morphological image of a bump-and-dip arrangement is indicated by lines; FIG. 4 is a schematically sectional view of the bottom of the inventive can bottle before pressurized, wherein four (or six or eight) flexed support legs are provided such that their sections appear uniformly at both ends of the drawing sheet, and they are uniformly arranged in the radial direction; and FIG. 5 is illustrative in schematic and section, as in FIG. 4, of how the bottom of the can bottle deforms as it is pressurized (the state of a positive pressure can).

It is here to be noted that the term "downward" or "down" means a direction toward the bottom of a can bottle when it is in an upright posture. In other words, when the can bottle is being held up, that term is defined as a direction in which the can bottle is placed upright on the bottom side. The opposite direction is "upward" or "up".

As shown in FIG. 1, the inventive can bottle 1 is formed of a metal material such as aluminum in a bottomed, cylindrical configuration comprising a cylindrical side wall 20 (the so-called can shank) and a bottom 30 joined to and integrated with that side wall 20.

On top of the side wall 20, there is an opening 10 provided, and there is a neck portion 11 provided around which a lid seal material such as a can lid (not shown) may be tightly sealed and fitted.

As shown in FIG. 1, the bottom 30 of the can bottle includes, and is constructed from, domed portions 31 that flex and extend downwardly and outwardly, and a plurality of flexed (or curved) support legs 35 that are formed by extending a plurality of peripheral sites of the domed portions arranged at uniform angles further downwardly and outwardly in a flexed fashion.

The configuration in which a plurality of flexed support legs 35 are positioned and constructed like a petal is sometimes called the petaloid configuration.

In FIGS. 1, 2 and 3, five flexed support legs 35 are shown as a preferable example. The number of the flexed support legs 35 is preferably four to eight, and most preferably five. Less than four legs will make it difficult to keep the can bottle stable by itself, and make stable delivery or the like impossible. Greater than eight legs will be very difficult to form.

Referring to FIGS. 4 and 5, there are four (or six or eight) flexed support legs provided such that their sections appear uniformly at both ends of each drawing sheet. That is, the flexed support legs 35 are shown in section to be arranged uniformly in the radial direction.

Due to the presence of the flexed support legs 35, unlike an ordinarily envisioned image, some domed portions 31 are defined by a gap between the adjacent flexed support legs 35 (in FIG. 1 there are five such gaps depicted), and one domed portion 31 is defined by a central portion of the bottom surrounded by the plurality of flexed support legs 35 (in FIG. 1 there is one central portion depicted), these domed portions being integrally joined to one another.

By looking at FIG. 4 with reference to FIG. 1, the morphology of the domed portion 31 could clearly be understood. Referring specifically to FIG. 4, the domed portion 31 indicated by a dotted line is the one positioned in a gap between the adjacent flexed support legs 35, and the domed portion 31 indicated by a solid line is the one positioned at the central portion of the bottom surrounded by the plurality of flexed support legs 35.

One characteristic feature of the invention is that, given the curvature of the domed portion at the bottom 30 defined by a radius of curvature $R_3$ (mm), the bottom is configured in such a way as to satisfy a specific condition: preferably $1.04 \leq R_3/D \leq 1.67$, and more preferably $1.17 \leq R_3/D \leq 1.33$ where D (mm) is the diameter of the cylindrical side wall 20. As a matter of course, the base point for $R_3$ (mm) is found on the axis P of the can bottle shown in FIG. 4.

In view of design, it could be difficult to divide the domed portion into multiple sites to locally vary the value of the radius of curvature $R_3$ defining the curvature of the domed portion in a place dependent fashion. However, if the joined or combined radius of locally varying, two or more radii of curvature is used for determining the curvature of the domed portion, a certain radius of curvature $R_3$ refigured out of three points: central portion G1, and G2 and G3 contiguous to the side wall 20 in FIG. 1 may be applied as the radius of curvature $R_3$ (mm) referred to herein.

A general can of beer has a diameter D of 66 mm, and given the relation of this diameter D to the can thickness as an example, the radius of curvature $R_3$ must be 68.7 to 110.1 mm, preferably 72.1 to 99.2 mm, more preferably 73.0 to 97.0 mm, and most preferably 77.2 to 87.5 mm.

When the outer diameter of the cylindrical side wall 20 varies locally in the axial direction, a diameter D distribution may be taken in the longitudinal (axial) direction to determine the most frequently found value of D as the diameter D (mm) of the cylindrical side wall 20. The diameter D (mm) used herein may be in a range of 52 mm to 95 mm.

The height L (mm) of each flexed support leg 35 herein (distance L in the height direction from point G3 at which the outermost portion of the radius of curvature $R_3$ of the domed portion crosses the cylindrical side wall 20 to a plane 70 on which the can bottle sits as shown in FIG. 4) is given by $0.12 \leq L/D \leq 0.18$, and preferably $L/D=0.15$ where D (mm) is the diameter of the side wall 20. In consideration of L alone, the value of L is in a range of 8 to 12 mm, and preferably 10 mm if the diameter D is 66 mm. Processing limits to aluminum impose some restriction on the height of the flexed support legs 35 in view of the diameter D.

The average thickness t (mm) of the bottom 30 herein is given by $0.0030 \leq t/D \leq 0.0045$, and preferably $t/D=0.0030$ where D is the diameter of the side wall 20. In consideration of t alone, the value of t is in a range of 0.20 to 0.30 mm, preferably 0.20 to 0.25 mm, more preferably 0.20 to 0.22 mm, and most preferably 0.20 mm if the diameter D is 66 mm.

As the value of the aforesaid $R_3/D$ gets less than 1.04, the distance H from the lowermost position G1 of the domed portion to the plane 70 in FIG. 4 tends to get short. When, in that state, a positive pressure can product having an internal pressure of 640 kPa is made, there will be inconvenience: the can bottle will be unable to satisfy the freestanding capability. As the value of $R_3/D$ exceeds 1.67, on the other hand, a positive pressure can product having an internal pressure of 640 kPa will grow too high because the downward stretching $\Delta L$ of the flexed support leg 35 shown in FIG. 5 will exceed 1 mm, resulting in jamming during can delivery, poor packaging or other inconveniences.

For further details of the determination of these $R_3/D$ values, see Specific Experiment Examples to be given later.

It is here to be noted that in the sectional view of FIG. 4, the value of the radius $R_1$ of the flexed support leg 35 is given by $0.12 \leq R_1/D \leq 0.18$ where D (mm) is the diameter of the side wall 20. The value of $R_1$ alone is 8 to 12 mm, preferably 9 to 11 mm, and more preferably 10 mm if the diameter D is 66 mm. In the sectional view of FIG. 4, the value of the radius $R_2$ extending from the flexed support leg 35 and joined to the domed portion positioned at the central site is given by $0.12 \leq R_2/D \leq 0.18$, and the value of $R_2$ alone is 8 to 12 mm, preferably 9 to 11 mm, and more preferably 10 mm if the diameter D is 66 mm.

Explanation of Drink Can Products

After the can bottle in a bottomed, cylindrical configuration provided with the bottom having such configuration features as described above is filled up with a soft or hard drink, a lid is tightly sealed and fitted over the opening 10, whereby a drink can product is formed. The soft or hard drinks to be filled up in the can preferably include carbonated soft and hard drinks that create a positive internal pressure in the can, for instance, beers, beer-like drinks, the so-called third beers, carbonated beverages, and carbonated wines.

The invention is preferably applied to soft or hard drink can products having an internal pressure of up to 640 kPa.

EXAMPLES OF THE FIRST ASPECT OF THE INVENTION

The first aspect of the invention is now explained more specifically to the specific experiment examples regarding the can bottle in a bottomed, cylindrical configuration.

Experiment Example 1-1

By way of simulation using the finite element method, the so-called petaloid configuration was searched, and resisting pressure analysis was carried out.

The prerequisites for the searching of the bottom configuration were to clear the following configuration checkpoints.

Configuration Searching

The resisting pressure strength of 640 kPa have had to be guaranteed, and for displacements of the central portion and legs at the can bottom (at an internal pressure of 640 kPa), the central portion have had to be spaced up away from the bottom (make sure the freestanding capability of the can), and an increment of up to 1.0 mm was allowed for the leg.

The resisting pressure analysis was carried out as follows.

Resisting Pressure Analysis (I) Design Parameters

The thickness of the bottom was set at 0.20 to 0.30 mm.

The values of the following configuration-setting factors remained constant.

Leg Height L (see FIG. 4): 10 mm

Leg Bulging $R_1$ (see FIG. 4): 10 mm

Joining $R_2$ of the leg to the domed portion (see FIG. 4): 10 mm

Diameter D of the cylindrical side wall 20: 66 mm

Accordingly, the variables are the radius of curvature $R_3$ (mm) that defines the curvature of the domed portion with respect to the diameter D, and the initial height H (see FIG. 4) of the central portion of the bottom affected by that value (with no internal pressure). In the experiment here, if $R_3/D$ is determined, then the height H of the central portion of the bottom gets determined, because the diameter D remains constant.

Set out below are the criteria for the determination of resisting pressure strength.

Criteria for the Determination of Resisting Pressure Strength (1) $\Delta H-\Delta L<H$ (at an internal pressure of 640 kPa)

(2) $\Delta L<1.0$ mm (at an internal pressure of 640 kPa) where $\Delta H$ is the amount of deformation of the bottom's central portion, $\Delta L$ is the amount of deformation of the leg (see FIG. 5), and H is the initial height of the bottom's central portion (with no internal pressure) (see FIG. 4).

If Criterion (1) is not satisfied, it is condemned or judged as being lack of the freestanding capability. If Criterion (2) is not satisfied, it is condemned or judged as being too large in terms of leg stretching.

On the basis of such criteria for the determination of resisting pressure strength, the $R_3/D$ range capable of satisfying Criteria (1) and (2) at the internal pressure of 640 kPa was determined while the thicker bottom portion was varied in thickness between 0.20 mm and 0.30 mm.

The results are shown in Table 1.

TABLE 1

| | Bottom's Thickness (mm) | | |
|---|---|---|---|
| | 0.20 | 0.25 | 0.30 |
| $R_3/D$ range capable of satisfying the following Conditions (1) and (2) at the internal pressure of 640 kPa | 1.17~1.33 | 1.09~1.50 | 1.04~1.67 |

(1) $\Delta H - \Delta L < H$ (at the internal pressure of 640 kPa)

(2) $\Delta L < 1.0$ mm (at the internal pressure of 640 kPA) where $\Delta H$ is the amount of deformation of the bottom's central portion, $\Delta L$ is the amount of deformation of the leg (see FIG. 5), and H is the initial height of the bottom's central portion (with no internal pressure) (see FIG. 4).

In conjunction with Table 1, specific values indicative of how much the can bottle deformed as well as the results of estimation of the freestanding capability and leg stretching at the bottom's thickness of 0.20 mm and the $R_3/D$ value of 1.27, 0.98, and 1.74 are shown in Table 2.

TABLE 2

(at the bottom's thickness of 0.20 mm)

| | $R_3/D$ | H | $\Delta H - \Delta L$ | $\Delta L$ | Free-standing | Leg Stretching |
|---|---|---|---|---|---|---|
| Ex. 1-I-1 | 1.27 | 3.2 | 2.26 | 0.85 | ○ | ○ |
| Comparative Ex. 1-I-1 | 0.98 | 1.0 | 1.57 | 0.72 | X | ○ |
| Comparative Ex. 1-I-2 | 1.74 | 5.1 | 3.44 | 1.35 | ○ | X |

Freestanding Capability ○

Condition (1): $\Delta H-\Delta L<H$ at the internal pressure of 640 kPa is satisfied.

Freestanding Capability X

Condition (1): $\Delta H-\Delta L<H$ at the internal pressure of 640 kPa is unsatisfied.

Leg Stretching ○

Condition (2): $\Delta L<1.0$ mm at the internal pressure of 640 kPa is satisfied.

Leg Stretching X

Condition (2): $\Delta L<1.0$ mm at the internal pressure of 640 kPa is unsatisfied.

In conjunction with Table 1, specific values indicative of how much the can bottle deformed as well as the results of estimation of the freestanding capability and leg stretching at the bottom's thickness of 0.25 mm and the $R_3/D$ value of 1.27, 0.98, and 1.74 are shown in Table 3.

TABLE 3

(at the bottom's thickness of 0.25 mm)

| | $R_3/D$ | H | $\Delta H - \Delta L$ | $\Delta L$ | Free-standing | Leg Stretching |
|---|---|---|---|---|---|---|
| Ex. 1-II-1 | 1.27 | 3.2 | 1.90 | 0.71 | ○ | ○ |
| Comparative Ex. 1-II-1 | 0.98 | 2.0 | 1.29 | 0.60 | X | ○ |
| Comparative Ex. 1-II-2 | 1.74 | 5.1 | 3.01 | 1.17 | ○ | X |

In conjunction with Table 1, specific values indicative of how much the can bottle deformed as well as the results of estimation of freestanding capability and leg stretching at the bottom's thickness of 0.30 mm and the $R_3/D$ value of 1.27, 0.98, and 1.74 are shown in Table 4.

TABLE 4

(at the bottom's thickness of 0.30 mm)

| | $R_3/D$ | H | $\Delta H - \Delta L$ | $\Delta L$ | Free-Standing | Leg Stretching |
|---|---|---|---|---|---|---|
| Ex. 1-III-1 | 1.27 | 3.2 | 1.61 | 0.60 | ○ | ○ |
| Comparative Ex. 1-III-1 | 0.98 | 1.0 | 1.06 | 0.49 | X | ○ |
| Comparative Ex. 1-III-2 | 1.74 | 5.1 | 2.63 | 1.03 | ○ | X |

Experiment Example 1-II

Pursuant to Experiment Example 1-I, simulation experimentation for the determination of the ranges of other parameters making sure the advantages of the invention was carried out in conjunction with the diameter D of the can bottle while that diameter D was varied in a range of 52 mm to 95 mm.

As a result, it has experimentally been found that the advantages of the invention are ensured within the ranges defined by the following relations or conditions:

$$1.04 \le R_3/D \le 1.67$$

$$0.0030 \le t/D \le 0.0045$$

$$0.12 \le L/D \le 0.18$$

$$0.12 \le R_1/D \le 0.18$$

$$0.12 \le R_2/D \le 0.18$$

From the aforesaid results, the advantages of the first aspect of the invention could clearly be understood. That is, the first aspect of the invention provide a can bottle in a bottomed, cylindrical configuration, which is constructed of a metal material and comprising a cylindrical side wall and a bottom joined to and integrated with said side wall, wherein said bottom includes domed portions that flex and extend downwardly and outwardly, and flexed support legs formed by extending a plurality of peripheral edge sites of said domed portions arranged at uniform angles further downwardly and outwardly in a flexed fashion, wherein said bottom satisfies a condition: $1.04 \leq R_3/D \leq 1.67$ where $R_3$ (mm) is the radius of curvature that defines the curvature of the domed portion at the bottom, and D (mm) is the diameter of the cylindrical side wall. The arrangement being like this, even though the bottom of the can bottle is thinned, it is possible just only to maintain the rigidity of the bottom of the can bottle but also to make sure the freestanding capability of the can bottle as the internal pressure grows high, for instance, even when the internal pressure of the soft or hard drink can bottle that has been filled up with a carbonated drink and sealed with a lid reaches as high as 640 kPa.

Explanation of the Second Aspect of the Invention

The can bottle in a bottomed, cylindrical configuration according to the second aspect of the invention, and a drink can product obtained by filling a drink in that can bottle and sealing it with a lid will now be explained in further details.

First of all, the can bottle in a bottomed, cylindrical configuration is explained.

Explanation of the Can Bottle in a Bottomed, Cylindrical Configuration

Figure 6:
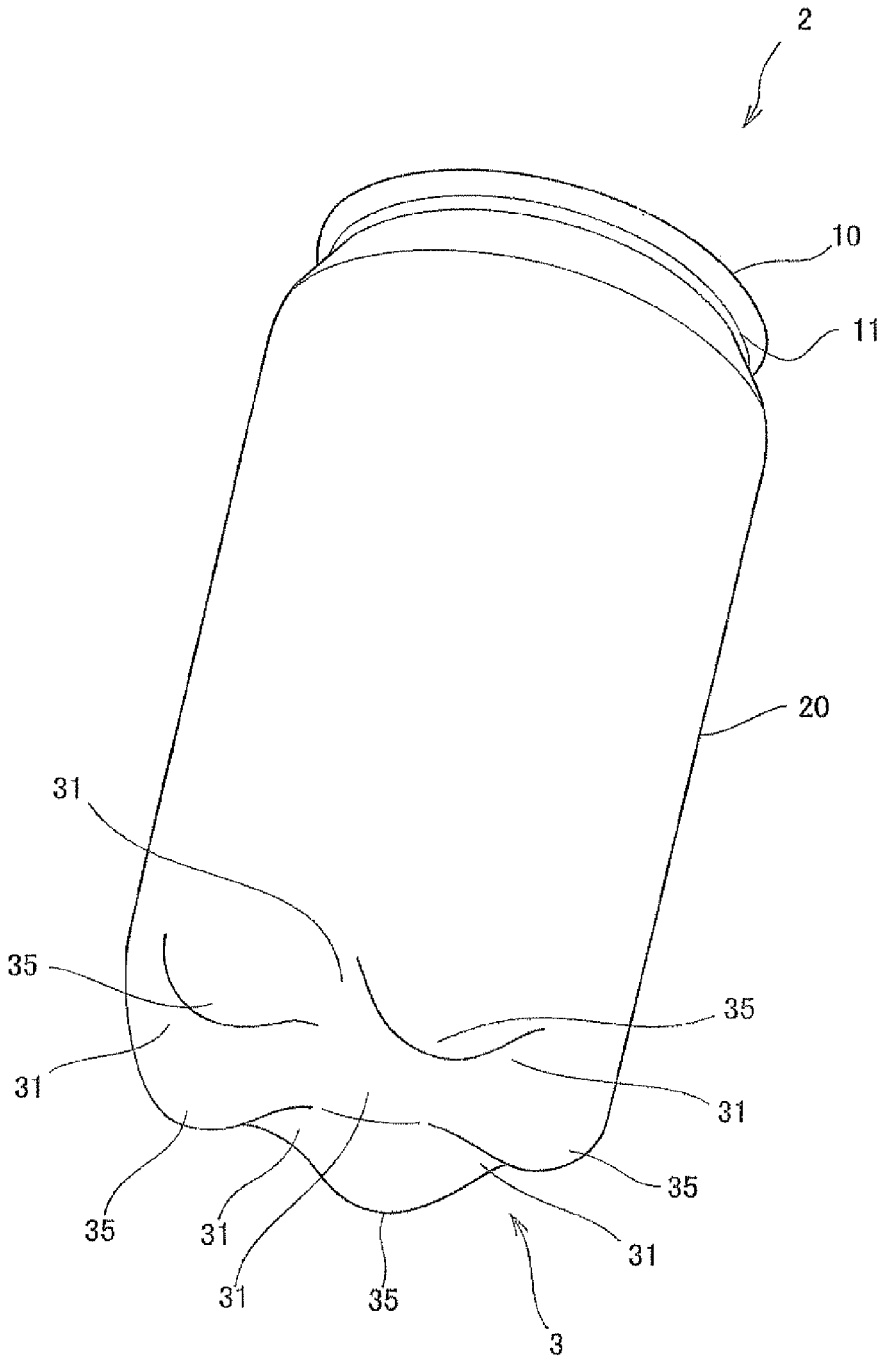
FIG. 6 is a schematic perspective view of the inventive can bottle in a cylindrical bottomed configuration, as viewed from the bottom direction.
Figure 7:
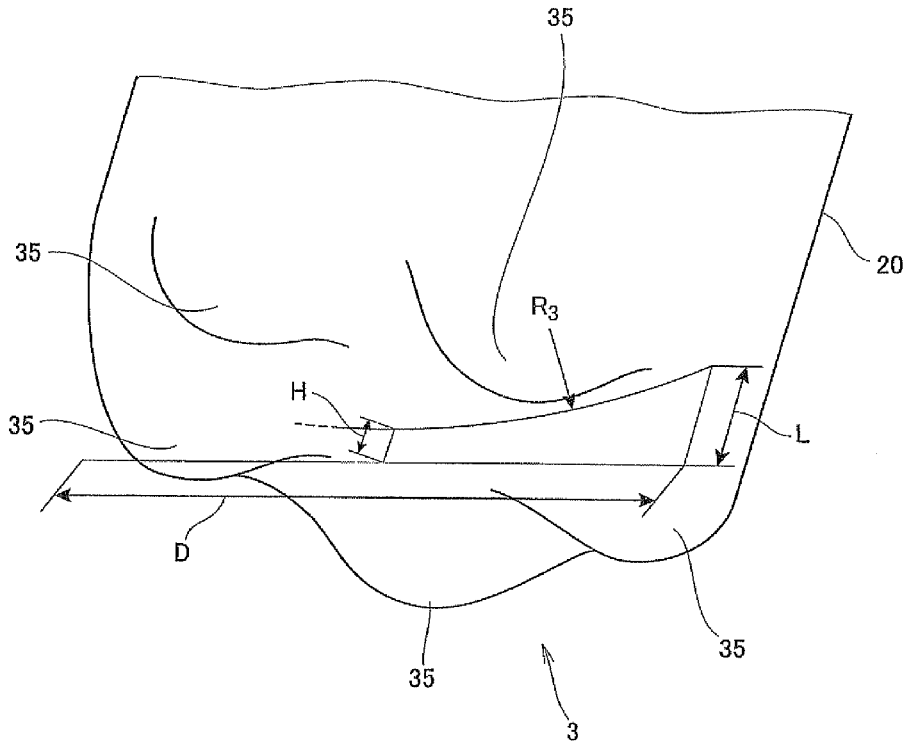
FIG. 7 is a schematically enlarged perspective view of the bottom of the inventive can bottle in a bottomed, cylindrical configuration.
Figure 8:
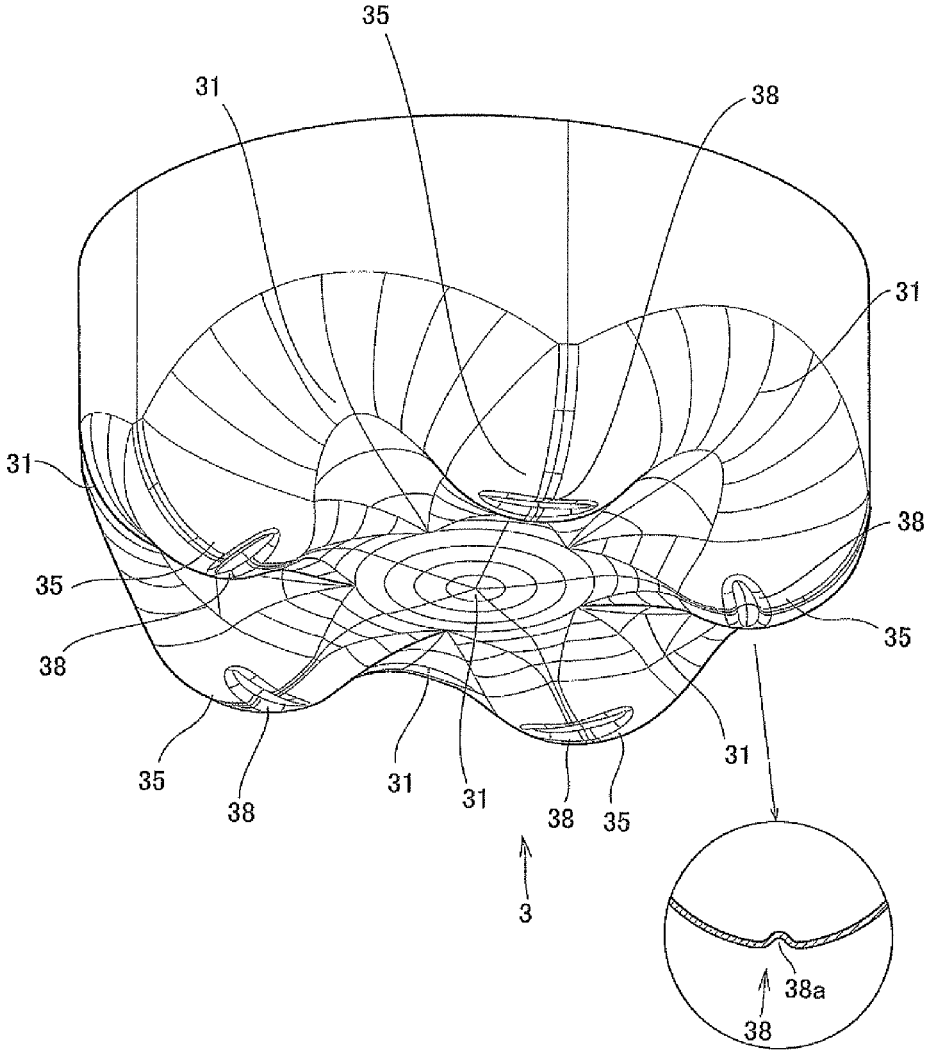
FIG. 8 is a schematically enlarged perspective view, as in FIG. 7, of the bottom, wherein the morphological image of a bump-and-dip arrangement is indicated by lines: the bump form at the bottom in general, and one preferable form of the ribs in particular that is part of the invention is clearly shown. Note here that one rib is shown in partial section.

FIG. 6 is a schematic perspective view of the inventive can bottle in a cylindrical bottomed configuration, as viewed from the bottom direction; FIG. 7 is a schematically enlarged perspective view of the bottom of the inventive can bottle; FIG. 8 is a schematically enlarged perspective view, as in FIG. 7, of the bottom, wherein the morphological image of a bump-and-dip arrangement is indicated by lines: the bump form at the bottom in general, and one preferable form of the ribs in particular that is part of the invention is clearly shown. In FIGS. 6 and 7 schematically illustrative of the can bottle, the ribs that are part of the invention are left out.

Figure 9:
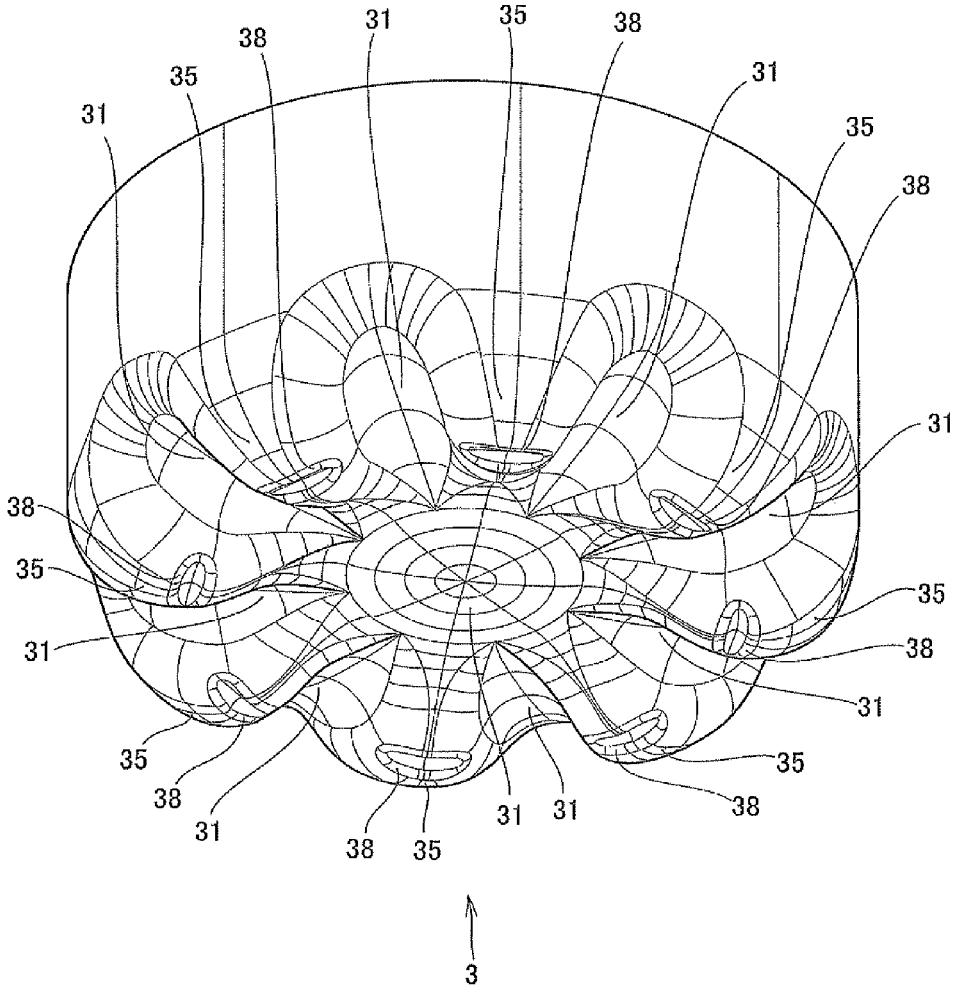
FIG. 9 is a schematically enlarged perspective view of the bottom in a modification to FIG. 8, wherein there are 8 flexed support legs provided.
Figure 10:
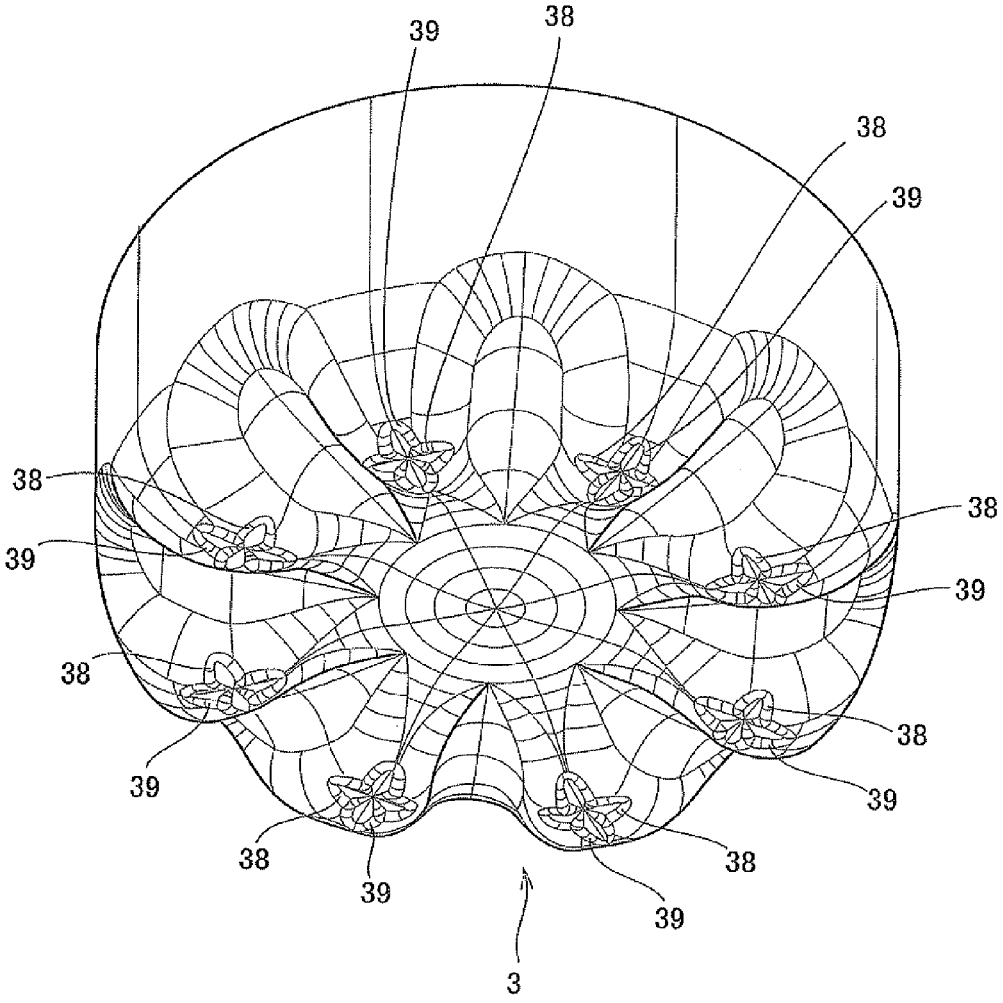
FIG. 10 is a schematically enlarged perspective view of the bottom in a modification to FIG. 9, wherein there are two ribs crossing each other at the most extended position.
Figure 11:
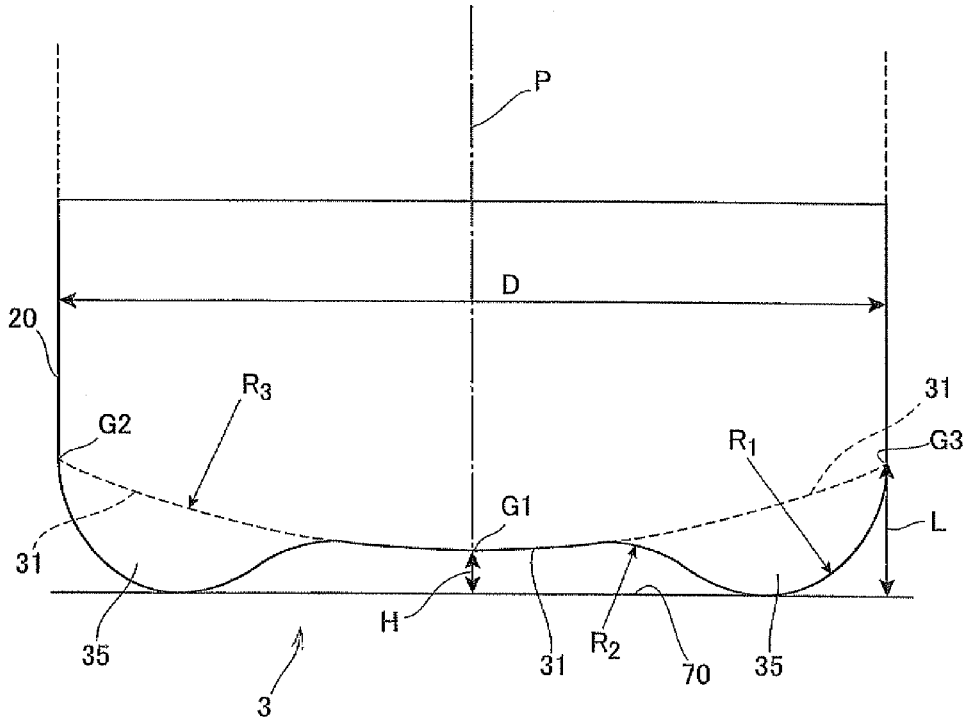
FIG. 11 is a schematically sectional view of the bottom of the can bottle, wherein four (or six or eight) flexed support legs are provided such that the sections of the flexed support legs appear uniformly at both ends of the drawing sheet (but the ribs are left out), and the flexed support legs are arranged uniformly in the radial direction. Note here that the interior of the can bottle is not yet pressurized.
Figure 12:
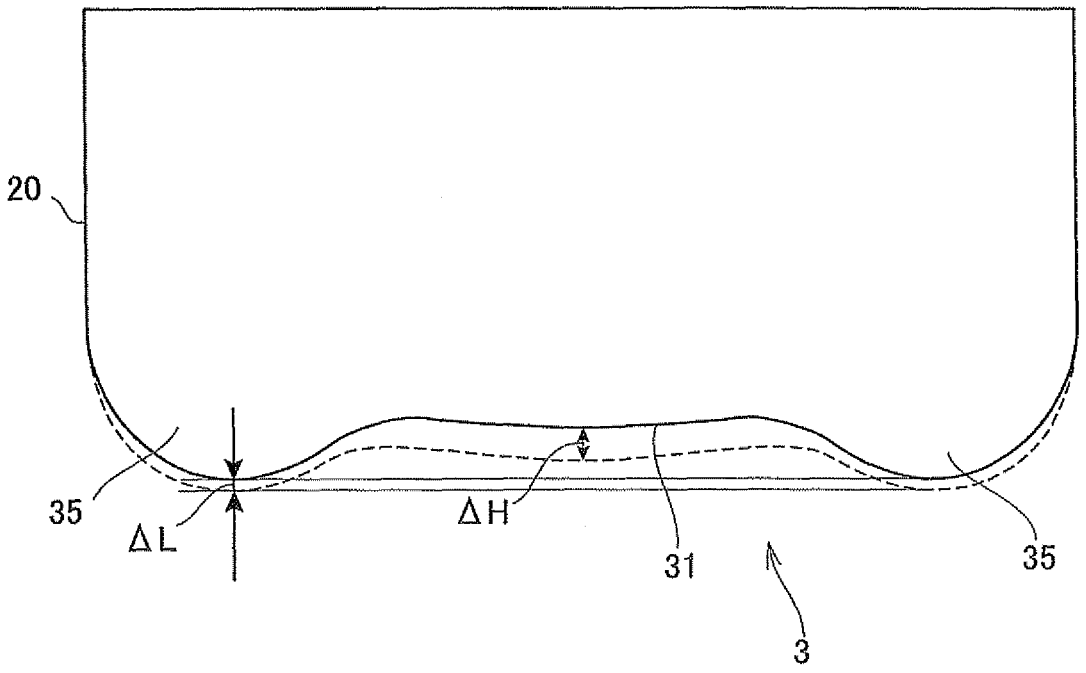
FIG. 12 is a schematically sectional view of how the bottom of the can bottle serving as a drink can product deforms by being pressurized, wherein four (or six or eight) flexed support legs are provided such that the sections of the flexed support legs appear uniformly at both ends of the drawing sheet (but the ribs are left out), and the flexed support legs are arranged uniformly in the radial direction. A solid line and a dotted line at the bottom are indicative of before and after pressurization, respectively. That is, the dotted line is indicative of the drink can product that is being pressurized or a positive pressure can.

FIG. 9 is a schematically enlarged perspective view of the bottom in a modification to FIG. 8, wherein there are eight flexed support legs provided. FIG. 10 is a schematically enlarged perspective view of the bottom in a modification to FIG. 9, wherein there are two ribs crossing each other at the most extended position. FIG. 11 is a schematically sectional view of the bottom of the can bottle, wherein four (or six or eight) flexed support legs are provided such that the sections of the flexed support legs appear uniformly at both ends of the drawing sheet (but the ribs are left out), and the flexed support legs are arranged uniformly in the radial direction. Note here that the interior of the can bottle is not yet pressurized. FIG. 12 is a schematically sectional view of how the bottom of the can bottle serving as a drink can product deforms by being pressurized, wherein four (or six or eight) flexed support legs are provided such that the sections of the flexed support legs appear uniformly at both ends of the drawing sheet (but the ribs are left out), and the flexed support legs are arranged uniformly in the radial direction. A solid line and a dotted line at the bottom are indicative of before and after pressurization, respectively.

It is here to be noted that the term "downward" or "down" means a direction toward the bottom of a can bottle when it is in an upright posture. In other words, when the can bottle is being held up, that term is defined as a direction in which the can bottle is placed upright on the bottom side. The opposite direction is "upward" or "up".

As shown in FIG. 6, the inventive can bottle 2 is formed of a metal material such as aluminum in a bottomed, cylindrical configuration comprising a cylindrical side wall 20 (the so-called can shank) and a bottom 3 joined to and integrated with that side wall 20.

On top of the side wall 20, there is an opening 10 provided, and there is a neck portion 11 provided around which a lid seal material (not shown) such as a can lid may be tightly sealed and fitted.

As shown in FIG. 6, the bottom 3 of the can bottle comprises domed portions 31 that flex and extend downwardly and outwardly, and flexed support legs 35 formed by extending (or bulging out) a plurality of peripheral edge sites of the domed portions arranged at uniform angles further downwardly and outwardly in a flexed fashion. As shown in FIG. 8, the most characteristic feature of the invention is that at possible grounding sites of the flexed support legs 35 at the bottom, there are ribs 38 formed in a direction crossing the radial direction. In the embodiment shown in FIG. 8, five such flexed support legs 35 are each provided with one rib 38.

Due to the presence of the flexed support legs 35, unlike an ordinarily envisioned image, some domed portions 31 are defined by a gap between the adjacent flexed support legs 35 (in FIG. 6 there are five such gaps depicted), and one domed portion 31 is defined by a central portion of the bottom surrounded by the plurality of flexed support legs 35 (in FIG. 6 there is one central portion depicted), these domed portions being integrally joined to one another.

By looking at FIG. 11 with reference to FIG. 6, the configuration of the domed portions 31 could clearly be understood. Referring specifically to FIG. 11, the domed portion 31 indicated by a dotted line is the one positioned in a gap between the flexed support legs 35, and the domed portion 31 indicated by a solid line is the one positioned at the central portion of the bottom surrounded by the plurality of flexed support legs 35.

In the invention, as shown in FIG. 8, the ribs 38 are formed at the possible grounding sites of the flexed support legs at the bottom whereby the buckling strength of the thinner flexed support legs 35 with respect to vertical loads can be brought up.

The wording "possible grounding sites of the flexed support legs at the bottom" refers to sites where the flexed support legs would sit on a plane when the bottom side of the can bottle is placed thereon. In other words, the possible grounding sites of the flexed support legs at the bottom match the most extended positions of the flexed support legs 35, and the ribs 38 are formed in a direction crossing a radial line of flexion passing through those positions.

When, as shown in FIG. 8, there is one rib 38 provided for each flexed support leg 35, the crossing direction for the rib 38 should preferably be a substantially right-angle direction along a circumferential direction with respect to the radial direction. This is to achieve efficient improvements in buckling strength to vertical loads. The "substantially right-angle direction" here refers to a range of 90°±15°.

Each and every rib 38 acts as a reinforcement (bone) structure for giving rigidity or strength to thinner portions, and if the rib 38 has such action, there is no to particular limitation on rib morphology. In the invention, however, it is particularly preferred that the rib 38 takes on an elongated, dented groove form, with its longitudinal direction lying in the substantially right-angle direction along the circumferential direction with respect to the radial direction. The elongated, dented groove form is formed at the site of the bottom at which the flexed support leg is to be grounded in the direction crossing the radial direction, so the contour of that groove form assumes on an elongated, oval form. It follows that, as shown in the partially sectioned view of the rib attached to the lower right of FIG. 8, there is a concavely dented rib body portion 38*a* formed as viewed in section in the radial direction passing through the most extended position of the flexed support leg.

By the formation of the rib 38 of such morphology, there are two or more grounding points formed at the bottom per one flexed support leg 35. Preferably, two or more grounding points should be formed at the bottom by the rib's outer edge itself. The formation of two or more grounding points makes sure the prevention of inward slipping of the legs, resulting in a lot more improvements in the buckling strength to vertical loads, and leading to improvements in grounding stability as well.

FIG. 9 illustrates a modification to FIG. 8, and shows an embodiment wherein there are eight flexed support legs 35 provided, and one rib 38 is formed for each leg 35. As is the case with FIG. 8, it is then preferable that the rib 38 is positioned and formed at the possible grounding site of the flexed support leg 35 at the bottom in the substantially right-angle direction along the circumferential direction with respect to the radial direction.

FIG. 10 illustrates a further modification to FIG. 9, and shows an embodiment wherein another new rib 39 is added and formed at the most extended position of the flexed support leg 35 at the bottom in a radial line of flexion passing through that position, resulting in an arrangement wherein, as shown in FIG. 10, two ribs 38 and 39 cross each other (substantially orthogonal to each other) at the most extended position of the flexed support leg 35. By allowing two ribs 38 and 39 to cross each other (orthogonal to each other), there are four grounding points formed at the bottom per one flexed support leg 35, contributing much more to just only buckling strength with respect to vertical loads but grounding stability as well.

When there are two ribs 38 and 39 per one flexed support leg 35 as shown in FIG. 10, it is preferable that given the zero degree lying in the radial direction, there are (1) a rib combination of a 0°±15° rib and a 90°±150 rib (the same as shown in FIG. 10), and (2) a rib combination of a 45°±15° rib and a 135°±15° rib.

The configuration here in which a plurality of flexed support legs 35 are positioned and constructed like a petal is sometimes called the petaloid configuration.

In FIGS. 6, 7 and 8, five flexed support legs 35 are shown as a preferable example. The number of the flexed support legs 35 is preferably four to eight, and most preferably five. Less than four legs will make it difficult to keep the can bottle stable and upright by itself, and make stable delivery or the like impossible. Greater than eight legs will be very difficult to form.

In the invention, it is desired to rely upon bottom specifications capable of satisfying the following requirements or conditions for the purpose of making the bottom thinner and making sure the stable freestanding capability of the can bottle.

That is, the bottom of the can bottle should preferably be set up in such a way as to satisfy a condition: $1.04 \leq R_3/D \leq 1.67$, and preferably $1.17 \leq R_3/D \leq 1.33$ where $R_3$ (mm) is the radius of curvature that defines the curvature of the domed portion at the bottom 3, and D (mm) is the diameter of the cylindrical side wall 20. As a matter of course, the base point for $R_3$ (mm) is found on the axis P of the can bottle shown in FIG. 11.

In view of design, it could be difficult to divide the domed portion into multiple portions to locally vary the value of the radius of curvature $R_3$ defining the curvature of the domed portion in a place dependent fashion. However, if the joined or combined radius of locally different, two or more radii of curvature is used for determining the curvature of the domed portion, a certain radius of curvature $R_3$ refigured out of three points: central portion G1, and G2 and G3 contiguous to the side wall 20 in FIG. 11 may be applied as the radius of curvature $R_3$ (mm) referred to herein.

A general can of beer has a diameter D of 66 mm, and given the relation of this diameter D to the can thickness as an example, the radius of curvature $R_3$ must be 68.7 to 110.1 mm, preferably 72.1 to 99.2 mm, more preferably 73.0 to 97.0 mm, and most preferably 77.2 to 87.5 mm.

When the outer diameter of the cylindrical side wall varies locally in the axial direction, a diameter D distribution may be taken in the longitudinal (axial) direction to determine the most frequently found value of D as the diameter D (mm) of the cylindrical side wall 20. The diameter D (mm) used herein may be in a range of 52 mm to 95 mm.

The height L (mm) of each flexed support leg 35 herein (distance L in the height direction from point G3 at which the outermost portion of the radius of curvature $R_3$ of the domed portion crosses the side wall 20 to a plane 70 on which the can bottle sits as shown in FIG. 11) is given by $0.12 \leq L/D \leq 0.18$, and preferably $L/D=0.15$ where D (mm) is the diameter of the side wall 20. In consideration of L alone, the value of L is in a range of 8 to 12 mm, and preferably 10 mm if the diameter D is 66 mm. Processing limits to aluminum impose some restriction on the height of the flexed support leg 35 in view of the diameter D.

The average thickness t (mm) of the bottom 30 herein is given by $0.0030 \leq t/D \leq 0.0045$, and preferably $t/D=0.0030$ where D (mm) is the diameter of the side wall 20. In consideration of t alone, the value of t is in a range of 0.20 to 0.30 mm, preferably 0.20 to 0.25 mm, more preferably 0.20 to 0.22 mm, and most preferably 0.20 mm if the diameter D is 66 mm.

As the value of the aforesaid $R_3/D$ gets less than 1.04, the distance H from the lowermost position G1 of the domed portion to the plane 70 in FIG. 11 tends to get short. When, in that state, a positive pressure can product having an internal pressure of 640 kPa is made, there will be inconvenience: the can bottle will be unable to satisfy the freestanding capability. As the value of $R_3/D$ gets greater than 1.67, on the other hand, a positive pressure can product having an internal pressure of 640 kPa will grow too high because the downward stretching $\Delta L$ of the flexed support leg 35 shown in FIG. 12 will get greater than 1 mm, resulting in jamming during can delivery, poor packaging or other inconveniences.

It is here to be noted that in the sectional view of FIG. 11, the value of the radius $R_1$ of the flexed support leg 35 is given by $0.12 \leq R_1/D \leq 0.18$ where D (mm) is the diameter of the side wall 20. The value of $R_1$ alone is 8 to 12 mm, preferably 9 to 11 mm, and more preferably 10 mm if the diameter D is 66 mm. In the sectional view of FIG. 11, the value of the radius $R_2$ extending from the flexed support leg 35 and joined to the domed portion positioned at the central portion is given by $0.12 \leq R_2/D \leq 0.18$, and the value of $R_2$ alone is 8 to 12 mm, preferably 9 to 11 mm, and more preferably 10 mm if the diameter D is 66 mm.

Explanation of Drink Can Products

After the can bottle in a bottomed, cylindrical configuration provided with the bottom having such configuration features as described above is filled up with a soft or hard drink, a lid is tightly sealed and fitted over the opening 10, whereby a drink can product is formed. The soft or hard drinks filled up in the can preferably include carbonated soft and hard drinks that create a positive internal pressure in the can, for instance, beers, beer-like drinks, the so-called third beers, carbonated beverages, and carbonated wines.

The invention is preferably applied to soft or hard drink can products having an internal pressure of up to 640 kPa.

EXAMPLES OF THE SECOND ASPECT OF THE INVENTION

The second aspect of the invention is now explained more specifically to the specific experiment examples regarding the can bottle in a bottomed, cylindrical configuration.

Experiment Example 2-I

By way of simulation using the finite element method, the so-called petaloid configuration was analyzed in terms of buckling.

Buckling analysis was carried out as follows.

Buckling Analysis (I)

Analysis was carried out at the bottom's thickness of 0.25 mm. Note here that in a thickness range of 0.20 mm to 0.30 mm, too, the same effects as obtained in the case of 0.25 mm were confirmed through analysis.

Set out below are the bottom configuration-setting parameters.

Number of flexed support legs 35: 5 (see FIG. 8)
or 8 (see FIG. 9)
Leg height L (see FIG. 11): 10 mm
Leg bulging $R_1$ (see FIG. 11): 10 mm
Jointing $R_2$ of the leg to the domed portion (see FIG. 11): 10 mm
Diameter D of the cylindrical side wall 20: 66 mm
Radius of curvature $R_3$ of the domed portion (see FIG. 11): 84 mm
Distance H from the central can bottom to the plane at which the can bottle sits (see FIG. 11): 3.2 mm Rib's morphology and location:
(i) Inventive sample having one rib for each flexed support leg 35 as shown in FIGS. 8 and 9
Rib size
Diametrical width: 2 mm
Circumferential width: 10 mm
Depth: 1 mm at deepest
(ii) Comparative sample having no rib at all Resisting pressure strength was determined on the following basis.

Buckling Strength Determination Basis

When progressive compression load was applied to the sample at 10 mm/min., where in the load (N) the sample buckled up was measured: to what load (N) the sample was held out was measured.

Set out in Table 5, given below, are the numeral data indicative of the results of analysis.

TABLE 5

Buckling Strength (at the average bottom thickness of 0.25 mm)

| | Number of Legs | Rib | Buckling Strength (N) |
|---|---|---|---|
| Ex. 2-I-1 | 5 | Used | 900 |
| Comparative Ex. 2-I-1 | 5 | None | 700 |
| Ex. 2-I-2 | 8 | Used | 600 |
| Comparative Ex. 2-I-2 | 8 | None | 510 |

From the results set out in Table 5, the advantages of the invention could clearly be appreciated. That is, the second aspect of the invention provides a can bottle in a bottomed, cylindrical configuration, which is constructed of a metal material and comprising a cylindrical side wall and a bottom joined to and integrated with said side wall, wherein said bottom includes domed portions that flex and extend downwardly and outwardly, and flexed support legs formed by extending (or bulging out) a plurality of peripheral edge sites of the domed portions arranged at uniform angles further downwardly and outwardly in a flexed fashion, and wherein there are ribs formed at possible grounding sites of the flexed support legs at said bottom in a direction crossing the radial direction. The arrangement being like this, even when the bottom of the can bottle is thinned, it is possible to maintain the rigidity of that bottom. In particular, it is possible to prevent inward slippage of the legs, resulting in the ability to make buckling strength to vertical loads much higher.

APPLICABILITY TO THE INDUSTRY

The inventive can bottle in a bottomed, cylindrical configuration, and a drink can product in which that can bottle is filled up with a soft or hard drink, for instance, may find use in a variety of drink industries and general packaging industries.

What is claimed is:

1. A can having a cylindrical shape and being constructed of a metal material, the can comprising:
- a cylindrical side wall; and
- a bottom joined to and integrated with said side wall, the bottom including:
  - domed portions that flex and extend downwardly; and
  - support legs formed by flexing and extending a plurality of peripheral edge sites of the domed portions further downwardly; wherein
  - the plurality of peripheral edge sites are arranged at uniform angles;
  - ribs are formed at grounding sites of the support legs;
  - said grounding sites are sites where the support legs sit on a plane when the bottom side of the can is placed thereon;
  - said ribs have a concavely dented shape as viewed in cross-section along a radial direction of the bottom and an elongated shape when viewed from a bottom side; and
  - when viewed from the bottom side, an elongated direction of said ribs crosses the radial direction of the bottom, respectively.

2. The can recited in claim 1, wherein the grounding sites of the support legs define downwardly extended positions of the support legs.

3. The can recited in claim 1, wherein said ribs are formed such that there are two or more grounding points provided at the can's bottom per one support leg.

4. The can recited in claim 1, wherein said ribs are formed such that each edge of said ribs include two or more grounding points at the can's bottom.

5. The can recited in claim 1, wherein there are four to eight support legs provided, each including one of the ribs.

6. The can recited in claim 1, wherein another rib is added to and formed at the downwardly extended position of the support leg at said bottom such that two ribs cross each other at the downwardly extended position.

7. The can recited in claim 6, wherein said two ribs cross each other, whereby there are four grounding points provided at the can bottom per one support leg.

8. The can recited in claim 1, wherein said domed portions include a first portion that is surrounded by the plurality of support legs and a plurality of second portions that are positioned between adjacent support legs; and said bottom satisfies a condition: $1.04 \leq R_3/D \leq 1.67$ where $R_3$ (mm) is a radius of curvature that defines a curvature of the first portion, and D (mm) is a diameter of the cylindrical side wall.

9. The can recited in claim 1, wherein a diameter D (mm) of the cylindrical side wall is set at 52 to 95 mm.

10. The can recited in claim 1, wherein a height L (mm) of each support leg is provided to satisfy $0.12 \leq L/D \leq 0.18$ where D (mm) is a diameter of the cylindrical side wall.

11. The can recited in claim 1, wherein the bottom has an average thickness t (mm) enough to satisfy $0.0030 \leq t/D \leq 0.0045$ where D (mm) is a diameter of the cylindrical side wall.

12. The can recited in claim 1, wherein the plurality of support legs are located and constructed in a petaloid configuration.

13. A drink product, which is formed by filling the can recited in claim 1 with a drink, and then sealing an opening with a lid.

14. The drink product recited in claim 13, wherein the can has an internal pressure that is within a range of up to 640 kPa.

15. The drink product recited in claim 13, wherein the drink is a carbonated drink.

* * * * *